US005310177A

United States Patent [19]

Conrad et al.

[11] Patent Number: 5,310,177

[45] Date of Patent: May 10, 1994

[54] NO-BEND GOLF DEVICE

[76] Inventors: Barry G. Conrad; Debra S. Conrad, both of P.O. Box 30, Swanton, Ohio 43558

[21] Appl. No.: 59,970

[22] Filed: May 13, 1993

[51] Int. Cl.[5] ..... A63B 57/00

[52] U.S. Cl. ..... 273/32.5; 273/32 B; 394/19.2

[58] Field of Search ..... 273/32 B, 32.5, 32 D, 273/34 F; 294/19.1, 19.2, 11

[56] References Cited

U.S. PATENT DOCUMENTS

| | | | |
|---|---|---|---|
| 824,642 | 6/1906 | Gibbs | 294/19.1 |
| 1,254,765 | 1/1918 | Binn | 294/11 |
| 1,853,899 | 4/1932 | Haverstick | 294/11 |
| 2,326,676 | 8/1943 | Peters | 294/11 |
| 2,609,198 | 9/1952 | Armstrong | 273/32.5 |
| 3,206,197 | 9/1965 | Miotke | 273/32.5 |
| 3,904,200 | 9/1975 | Jackle et al. | 294/19.2 |
| 4,526,369 | 7/1985 | Phelps | 273/32 B |
| 4,629,234 | 12/1986 | Sokolowski | 294/19.1 |
| 4,819,938 | 4/1989 | Hill | 273/32 B |
| 4,949,961 | 8/1990 | Milano | 294/19.1 |
| 4,969,646 | 11/1990 | Tobias | 294/19.2 |
| 5,165,744 | 11/1992 | Vogrin | 273/32.5 |

*Primary Examiner*—Mark S. Graham

[57] ABSTRACT

An apparatus for placement of golf balls and golf tees comprising an elongated shaft with a forked ball and tee holding device on the lower end of the shaft. The upper end of the shaft is comprised of a sliding pull hooked handle. It is operated by pulling the tee and ball inwards to the shaft with the hooked handle to form a compression. This holds the ball and tee together so it can be pushed into the ground. The weight of the forked foot drops the compression when the hooked handle is released, releasing the foot from the teed ball.

1 Claim, 2 Drawing Sheets

NO-BEND GOLF DEVICE

REFERENCES CITED

U.S. Pat. No. 2,609,198, September 1952 Armstrong, 273/32.5.

BACKGROUND OF THE INVENTION

The device is intended to allow a round of golf to be played without bending over. During a golf game bending is required for teeing, retrieving the tee, retrieving the ball, setting and retrieving the ball marker, fixing divots, and fixing ball marks. This device will accomplish all of these tasks.

SUMMARY

This device is designed so that a minimum of parts are required to accomplish these tasks. No springs are needed. The same fork is used to hold the tee and fix divots and ball marks. The design of the unit allows it to be laid on the ground and easily picked up with any club using the hooked handle. This unit can also pick up any club.

DRAWINGS

DESCRIPTION OF EMBODIMENT

Figure 1:
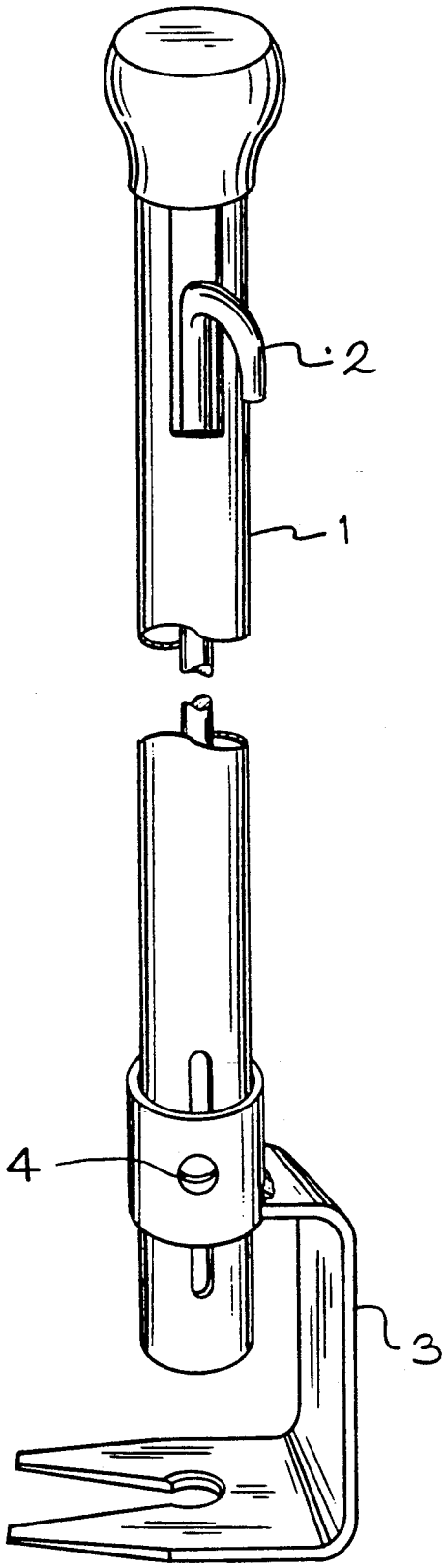
FIG. 1 is an angular side view of complete unit.
Figure 2:
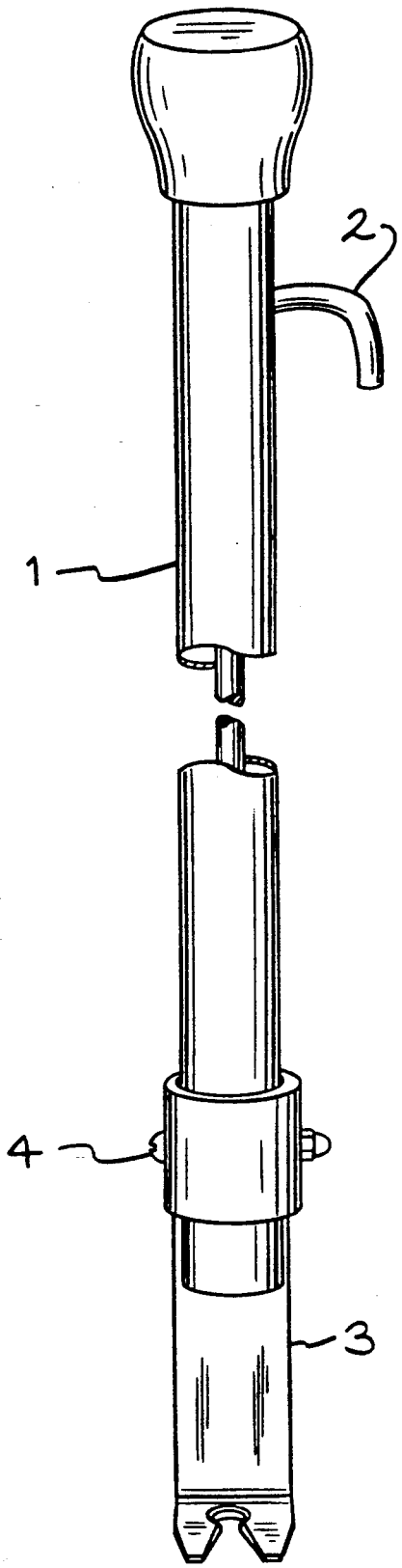
FIG. 2 is a front view of complete unit.
Figure 3:
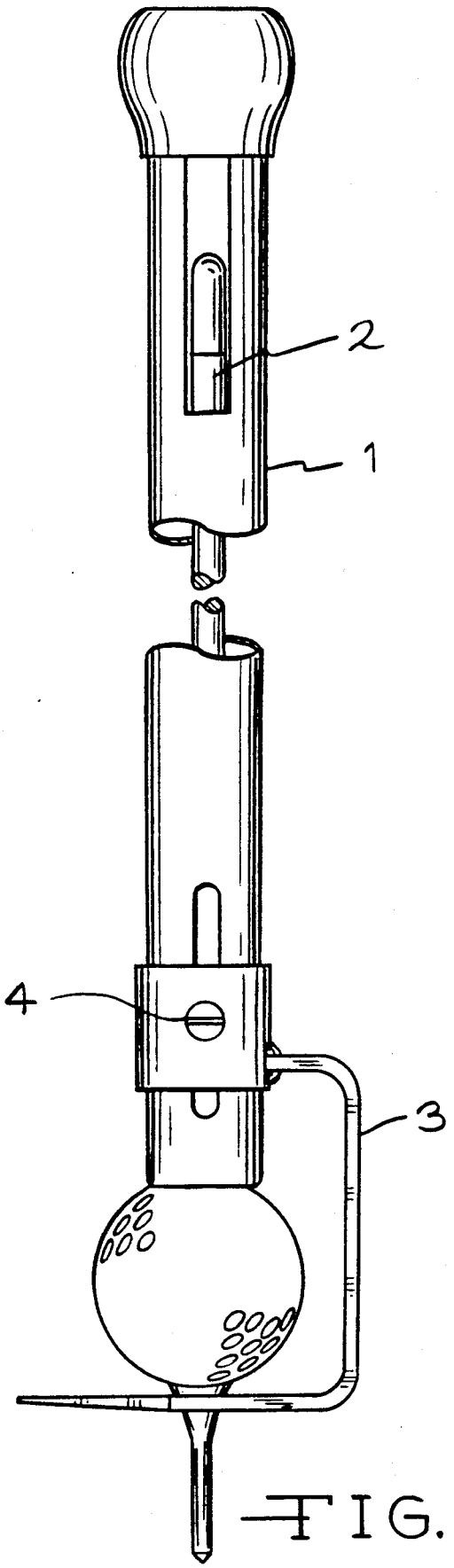
FIG. 3 is a side view of complete unit with ball and tee in place.
Figure 4:
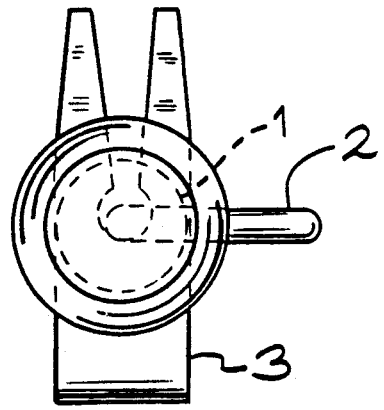
FIG. 4 is a top view with top #5 removed and #4 (bolt) not shown.

The unit consists of a long hollow tubular shaft. A long rod 2 runs down the inside of the tubular shaft and connects to a forked ball and tee setting device 3 that slides longitudinally on the outer surface of the tubular shaft. It is held in place by a single bolt 4 which runs through a slot in the tubular shaft and through the rod on the inside of the shaft. The rod runs up the top of the tubular shaft and protrudes out through the side of the shaft through another slot, so as to allow the rod and the forked foot to operate in a sliding motion longitudinally on the tube which allows the ball and the tee to be captured with such force as to be placed in the ground.

Once placed in the ground, the rod is released and the forked foot falls down releasing the tee and leaving the tube sitting on the ball which is sitting on the tee. The tube is then raised slightly to disengage the unit from the now free standing ball and tee and moved horizontally to remove the unit from the playing area.

We claim:

1. A golf ball and tee placement and retrieval apparatus comprising;

a hollow elongated shaft having first and second ends, an elongated rod slidably received within said shaft, and a foot element including a forked foot oriented at a right angle to said shaft and rod, said forked foot adapted to receive a tee and golf ball, said shaft having a longitudinally oriented slot at said first end and a pair of opposing longitudinally oriented slots at said second end, said rod having a handle at one end which passes through said first end slot, and a transverse bolt at an opposite end which passes through said second end slots, said foot element attached to said bolt on the outside of the shaft so that said foot may slide vertically on the outside of the shaft, wherein by sliding the rod relative to the shaft, the foot may be moved vertically to place or retrieve a ball and tee.

* * * * *